US007973482B2

(12) United States Patent
Brinkhoff et al.

(10) Patent No.: US 7,973,482 B2
(45) Date of Patent: Jul. 5, 2011

(54) HIGH-PRESSURE DISCHARGE LAMP WITH HALOGENS

(75) Inventors: Michael Brinkhoff, Kürten (DE); Hans-Jürgen Keck, Engelskirchen (DE); Rainer Kling, Wipperfürth (DE)

(73) Assignee: OSRAM Gesellschaft mit beschraenkler Haftung, Munich (DE)

( * ) Notice: Subject to any disclaimer, the term of this patent is extended or adjusted under 35 U.S.C. 154(b) by 462 days.

(21) Appl. No.: 11/578,238

(22) PCT Filed: Apr. 14, 2005

(86) PCT No.: PCT/DE2005/000684

§ 371 (c)(1), (2), (4) Date: Oct. 12, 2006

(87) PCT Pub. No.: WO2005/101455

PCT Pub. Date: Oct. 27, 2005

(65) Prior Publication Data

US 2007/0200504 A1 Aug. 30, 2007

(30) Foreign Application Priority Data

Apr. 16, 2004 (DE) ..... 10 2004 019 185

(51) Int. Cl.
*H01J 61/30* (2006.01)
*H01J 61/36* (2006.01)
*H01J 61/20* (2006.01)

(52) U.S. Cl. ..... 313/637; 313/571; 313/573; 313/574; 313/576; 313/639; 313/640

(58) Field of Classification Search ..... 313/631, 313/635, 638–641
See application file for complete search history.

(56) References Cited

U.S. PATENT DOCUMENTS

| | | | | | |
|---|---|---|---|---|---|
| 3,654,506 | A | | 4/1972 | Kuhl et al. | |
| 3,900,750 | A | | 8/1975 | Bamberg et al. | |
| 4,020,377 | A | * | 4/1977 | Popp et al. | 313/112 |
| 4,171,498 | A | * | 10/1979 | Fromm et al. | 313/641 |
| 4,232,243 | A | * | 11/1980 | Rigden | 313/623 |
| 4,281,267 | A | | 7/1981 | Johnson | |
| 4,319,157 | A | * | 3/1982 | De Vrijer | 313/642 |
| 4,342,937 | A | | 8/1982 | Nagel | |
| 4,866,342 | A | * | 9/1989 | Ramaiah et al. | 313/639 |
| 4,929,863 | A | | 5/1990 | Verbeek et al. | |
| 4,968,916 | A | | 11/1990 | Davenport et al. | |
| 5,479,065 | A | * | 12/1995 | Sugimoto et al. | 313/113 |
| 5,536,991 | A | | 7/1996 | Parham et al. | |
| 5,847,510 | A | * | 12/1998 | Goelling et al. | 313/623 |
| 5,929,563 | A | * | 7/1999 | Genz | 313/571 |

(Continued)

FOREIGN PATENT DOCUMENTS

CA 2 280 556 3/2000

(Continued)

OTHER PUBLICATIONS

English abstract for JP 05-198284, 1993.

(Continued)

*Primary Examiner* — Sikha Roy

(57) ABSTRACT

A high-pressure discharge lamp with an axial symmetry axis and metal halogenide filling has electrodes with shafts designed as pins with a diameter of 0.5 to 1.15 mm. The halogen for the halogenide is composed of iodine and possibly bromine components, iodine being used alone or in combination with bromine, and the bromine/iodine atomic ratio amounting to maximum 2.

8 Claims, 3 Drawing Sheets

U.S. PATENT DOCUMENTS

| | | | | |
|---|---|---|---|---|
| 6,107,742 | A | 8/2000 | Seki et al. | |
| 6,573,656 | B2 | 6/2003 | Kaneko et al. | |
| 7,414,368 | B2 * | 8/2008 | Rintamaki et al. | 313/637 |
| 7,486,026 | B2 * | 2/2009 | Johnston et al. | 313/641 |
| 2003/0102808 | A1 * | 6/2003 | Dakin et al. | 313/640 |

FOREIGN PATENT DOCUMENTS

| | | | |
|---|---|---|---|
| DE | 37 31 134 | A1 | 8/1988 |
| DE | 38 29 156 | A1 | 3/1989 |
| DE | 89 12 495 | | 1/1990 |
| DE | 40 30 202 | | 3/1992 |
| DE | 44 32 611 | | 3/1996 |
| DE | 195 30 821 | | 2/1997 |
| DE | 195 48 518 | | 6/1997 |
| DE | 198 43 418 | | 3/2000 |
| DE | 201 19 231 | | 4/2002 |
| DE | 102 56 389 | | 6/2004 |
| EP | 0 382 516 | | 8/1990 |
| EP | 0 391 283 | | 10/1990 |
| EP | 0 451 647 | | 10/1991 |
| JP | 44025266 | U | 10/1969 |
| JP | 58128559 | A | 8/1983 |
| JP | 6419671 | A | 1/1989 |
| JP | 64072453 | A | 3/1989 |
| JP | 05198284 | A | 8/1993 |
| JP | 09063535 | A | 3/1997 |
| WO | WO 98/09565 | | 3/1998 |

OTHER PUBLICATIONS

English abstract for JP 09-063535, 1997.

English abstract for JP 58-128559, 1983.

English abstract for JP 64-19671, 1989.

English translation of the relevant sections referring to reference JP 44-025266, 1969.

* cited by examiner

HIGH-PRESSURE DISCHARGE LAMP WITH HALOGENS

TECHNICAL FIELD

The invention proceeds from a high-pressure discharge lamp in accordance with the preamble of claim 1. What is involved here are metal halide lamps having a two-ended pinch and a high power of at least 1600 W. The invention further relates to an associated luminaire.

PRIOR ART

Such lamps are known from EP 391 283 and EP 451 647. They are suitable in principle for horizontal and vertical arrangement in a reflector.

DE-A 38 29 156 discloses a generic lamp for which a relatively high bromine/iodine ratio of 1.5 to 4 is recommended. It follows that a relatively large diameter of from 1.5 to 2 mm is required for the electrode shafts, because bromine attacks the shafts strongly.

SUMMARY OF THE INVENTION

It is an object of the present invention to provide a high-pressure discharge lamp in accordance with the preamble of claim 1 and in the case of which the service life satisfies high requirements, in particular in the case of which the decline in the transparency of the discharge vessel over the service life is canceled as far as possible.

This object is achieved by means of the characterizing features of claim 1. Particularly advantageous refinements are to be found in the dependent claims.

In detail, a discharge lamp is presented that is suitable both for horizontal and for vertical operation in a luminaire. This high-pressure discharge lamp has as features an elongated discharge vessel, as sole bulb, that defines an axial axis of symmetry and that is closed at two ends by sealing parts, for example by pinches or seals, and that encloses a discharge volume, two electrodes being opposite one another on the axis, and that contains an ionizable filling made from mercury, inert gas and metal halides, and supply leads that are connected to the electrodes via foils and that emerge at the ends of the discharge vessel, the lamp consuming a power of at least 1600 W. The shafts are designed as pins with a diameter of 0.5 to 1.15 mm. At the same time, the halogen for the halides is composed of the constituents iodine and, possibly, bromine, use being made either only of iodine or jointly of bromine and iodine, the bromine/iodine atomic ratio being 2 at most. It is preferably at most only 1.45.

In order to improve the thermal budget, at least a portion of the seal, mostly a pinch, that is adjacent to an electrode, is preferably provided with a reflecting coating. The coating is a metallic or nonmetallic layer, in particular made from zirconium oxide. This coating extends from the edge of the pinch at least 2 mm toward the foil, in particular at least over the entire length of the shaft introduced into the pinch. It is supplied at one end whenever the lamp is installed nearly vertically in a reflector, that is to say with a deviation of at most 45° from the vertical. This coating is fitted at both ends on both pinches in the case of nearly horizontal installation with a deviation of less than 45° from the horizontal.

As is known per se a portion of the two seals can be frosted in order to improve the thermal budget further. It is preferred in this case for the frosting to be a layer roughened by sandblasting or etching.

Metal halides of Hg and from the group of the elements Cs and rare earth metals such as Dy or Tm or Ho are particularly suitable as constituent of the filling, since they can be used for the effective setting of a color temperature of at least 3300 K, preferably at least 3800 K. Depending on the color temperature desired, it is recommended to add sodium and/or manganese as halide to the other metal halides. Furthermore, thallium halide, in particular thallium iodide, can be used to improve the color rendering index.

The high-pressure discharge lamp is fashioned in a particularly compact way because the discharge vessel (2) is the sole bulb.

The high-pressure discharge lamp is distinguished by the use of electrodes with shaft and head in the case of which the shafts have a diameter of at most 1.15 mm. Such thin shafts have previously not been used for lamps of this type, since the filling has previously contained a relatively large amount of bromine for an optimum halogen circuit, which attacks the shafts in a targeted fashion. However, it has emerged that, in a complete departure from expert opinion to date, for a relatively low color temperature not exceeding 6000 K a relatively low-bromine filling can be more effectively used, a bromine/iodine mixture up to an atomic ratio of at most 2 being capable of use here as halide.

The low-bromine filling is particularly advantageous whenever low color temperatures of neutral white light color are targeted with color temperatures between 3300 and 4800 K, preference being given here as halide either to iodine alone or a bromine/iodine mixture up to an atomic ratio of at most 1.45. Such low color temperatures have so far been completely incapable of implementation with the generic lamps. Such little bromine is only a slight load on the shafts. Typical of use is pure iodine at low outputs (typically 1600 W output) as far as a Br/I ratio of around 1.0 ±0.2 at higher outputs (typically 2000 W), said power relating to standard operation.

The thin shafts are particularly important because they relate to a critical point in the functioning of the lamp. The pin-shaped shaft is sealed in the silica glass and subject there to high thermal loading and a high voltage. The silica glass does not adhere to the pin, but a capillary is unavoidably formed between pin and silica glass. A portion of the filling condenses in the capillary and forms a dead volume for the filling. This effect leads to the previously observed poor maintenance of such lamps which, however, appeared unavoidable. In a departure from the previous technology, it now emerges that given careful selection of the bromine fraction thin pins are not only sufficiently stable such that even the current loading of typically 10 to 20 A poses no problem, but have the great advantage of a substantially smaller dead volume associated therewith. The point is that the thinner a pin, the narrower the dead volume arising around it in the seal. Moreover, thin pins improve the accumulation of heat in the region of the electrodes. In particular, in vertical operation even only one electrode can be fitted with a thin shaft, whereas the other has a conventional thick shaft with a typical diameter of 1.5 mm. The thin shaft moreover allows there to be laid between foil and discharge volume a relatively long distance that reduces the risk of explosion and lowers the thermal loading on the foil. The risk of explosion is based on the notch effect in the foil in the silica glass. The longer distance enlarges the dead volume only insubstantially, such that it still remains considerably below the value of thick pins such as previously used. A typical axial length of the pin in the silica glass, calculated from the pinch edge up to the beginning of the foil, is now 5 to 7 mm, whereas previously maximum values of 4 mm were used. An optimum for the diameter of the shaft with regard to stability, on the one hand, and dead volume, on the other hand, lies at approximately 0.9 to 1.1 mm. The shafts are fabricated, for example, from customary tungsten material.

Such lamps can be operated using a moderate cyclic process, and this leads to an outstanding maintenance. The lamps not only achieve an abnormally long service life of the order of magnitude of 2500 to 6000 and, typically, 4500 hours, but also an excellent stability of the lighting properties. This is in the order of magnitude of at least 90% and 1500 hours. The filling permits a high light yield of at least 90 lm/W in conjunction with good color rendition of at least Ra=85. These lamps are therefore ideally suited for purposes of general illumination in combination with the high service life.

The lamp according to the invention also achieves a service life of at least 2500 hours in the case of the particularly critical vertical operation in a compact luminaire; the lifetime is at least 4000 hours, by and large. The vertical operation enables a particularly high luminaire efficiency.

For applications in rooms or in twilight, the light color is neutral white, neutral white deluxe (NDL) being well suited for the highest requirements placed on color rendition, having a color temperature of approximately 4100 to 4400 K and an Ra of at least 85.

The lamp according to the invention is also suitable for indirect illumination, for example with mirror projector systems, in the case of which there is a demand for a high light flux.

Slight fractions of sodium and/or manganese are frequently contained as a constituent of photoactive metal halide fillings. It is thereby possible to achieve high light yields and the desired color contents. By contrast, a high sodium fraction leads to intensified corrosion of the discharge vessel, although it is mostly produced from silica glass. Consequently, the fraction of Na is as far as possible selected to be relatively slight alongside the further constituents of thallium, cesium and customary rare earth metals such as Dy, Ho or Tm, and in particular sodium is replaced entirely or partially by manganese.

In the case of rather low-voltage lamps, in particular approximately 1600 W, it is preferably possible to coat the ends of the discharge vessel with a reflecting layer only over a rather short length, typically 2 mm. This holds chiefly for neutral white fillings with a color temperature of 4000 to 4800 K. The result overall is to increase the temperature of the cold spot, but also the foil end temperature and the wall loading such that they reach optimum values. An optimum foil end temperature is 350 to 390° C. It can, for example, be set in a targeted manner by means of the distance of the foil from the discharge volume, and its length. At a relatively high temperature, early corrosion leading to a shortened service life is a threat. The wall loading is at best at values from approximately 60 to 75 W/cm$^2$.

In the case of rather high-voltage lamps, in particular 1800 to 2500 W and higher, it is preferred to use fillings with a slight fraction of Na, or none at all. Moreover, a greater length of the reflecting layer is recommended here. Starting from the pinch edge, it should comprise at least the shaft as far as the foil and, in particular, at least still that part of the foil on which the shaft is welded. It preferably still extends a few millimeters therebeyond.

Since these lamps are much more strongly subject to thermal loading, a frosting of the pinches is further worthy of recommendation here. As a result, the temperature of the foil ends is limited to at most 350 to 390° C. even in a narrow luminaire.

The temperature at the foil end is particularly critical. The frosting should therefore cover the region of the outer foil end. It expediently extends up to the end of the pinch. On the inside, toward the discharge, it can extend at least up to the middle of the foil, and in some circumstances even substantially therebeyond, for example up to the inner end of the foil.

Typical distances between the electrode tips are 25 to 35 mm for particularly compact luminaries, but even distances of up to 100 mm or more are possible. A minimum distance is at 20 mm.

FIGURES

The aim below is to explain the invention in more detail with the aid of a number of exemplary embodiments. In the drawing:

FIG. 1 shows a metal halide lamp in side view; and

FIGS. 2 and 3 respectively show a further exemplary embodiment of a metal halide lamp.

DESCRIPTION OF THE DRAWINGS

A 1600 W high-pressure discharge lamp 1 without external bulb and having a length of approximately 190 mm is illustrated schematically in FIG. 1; it is described in more detail in U.S. Pat. No. 5,142,195, for example. It is intended for use in reflectors, in which case it is arranged axially relative to the reflector axis.

The discharge vessel 2 made from silica glass defines a longitudinal axis X and is designed as a barrel element 3 whose generatrix is a circular arc. The discharge volume is approximately 20 cm$^3$. The rod-shaped tungsten electrodes 6 with coil 7 pushed on as head are aligned axially at the two ends of the discharge vessel in pinches 5. The electrodes 6 are fastened in the pinch 5 on foils 8 where outer supply leads 9 are attached. A ceramic base 11 is fastened by means of cement (not shown) on the end 20 of the pinch 5 remote from the discharge. The discharge vessel 2 contains a filling made from an inert gas as start gas, mercury and metal halides. HgBr2 and HgJ2 as well as the photoactive filling NaI, CsI, TlI and DyI3 as well as TmI3 are used as metal halides. The ratio Br/I is at approximately 0.2. The lamp is operated horizontally. The cold filling pressure of the start gas is at most 1 bar.

In this exemplary embodiment, the light color is implemented by the filling as neutral white with a typical color temperature of 4000 K. A typical diameter of the shaft 6 of the electrode is 1.0 mm. After a service life of 2000 hours, the rise in operating voltage was only 4% and the maintenance of the light flux was 10%.

Figure 1:
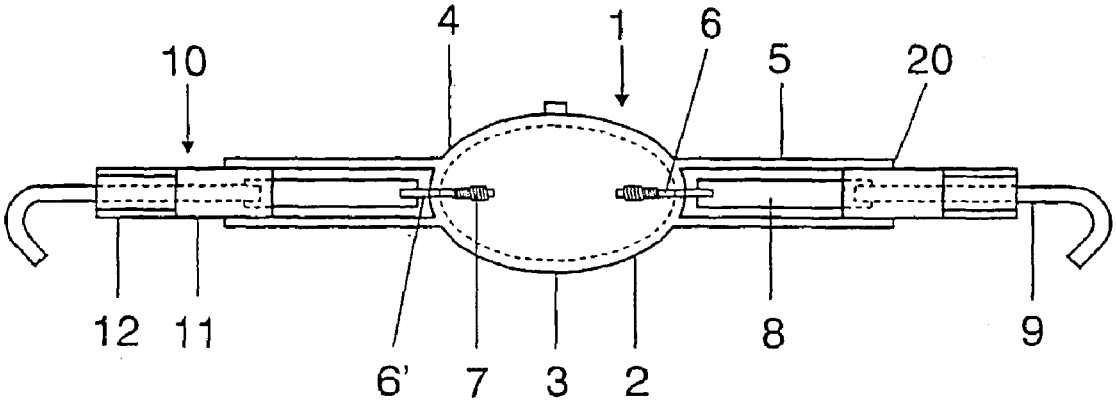
Figure 2:
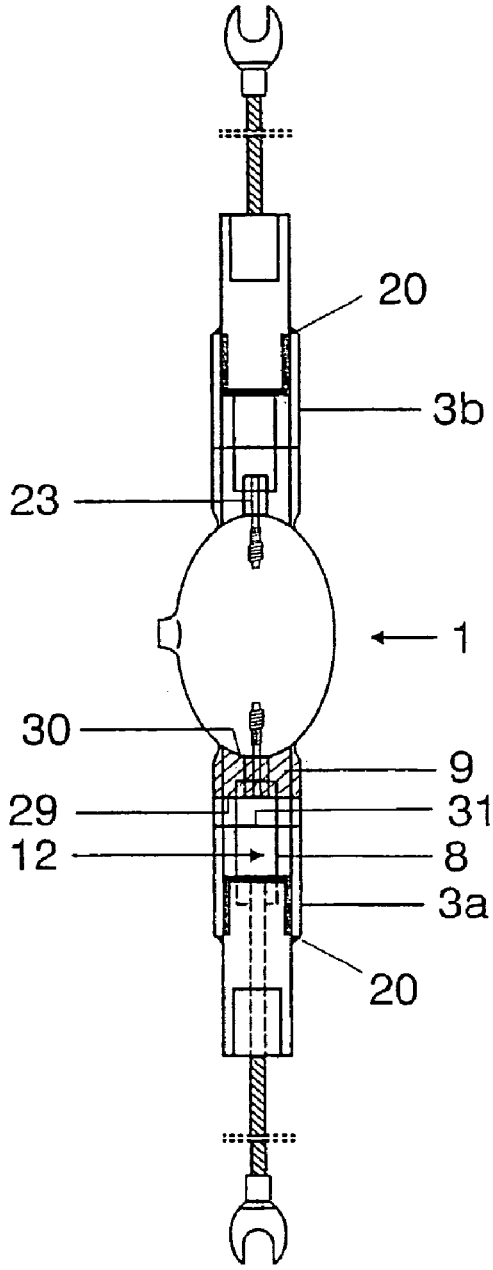

HgBr2 and the photoactive filling of NaI, CsI, TlI3 and DyI3 as well as TmI3 are recommended as metal halides in the case of a vertically operated 2000 W lamp (FIG. 2). The ratio Br/I is approximately 0.9.

A typical filling is:

CsI: 0.05 to 0.3 μmol/cm$^3$;
DyI3: 0.2 to 0.8 μmol/cm$^3$;
NaI: 0 to 1.4 μmol/cm$^3$;
MnI2: 0 to 2.4 μmol/cm$^3$;
TlI: 0.05 to 0.7 μmol/cm$^3$;
TmI3: 0.2 to 0.8 μmol/cm$^3$;
HgI2: 0 to 1.5 μmol/cm$^3$;
HgBr2: 0 to 3 μmol/cm$^3$.

A relatively narrow coating 9 on the lower pinch 3*a* lowers the wall loading caused thereby. A value of at most 75 W/cm$^2$ is desired for the wall loading. Good results are yielded by a wall loading of 65 to 70 W/cm$^2$. Moreover, the heat accumulation effect is further increased in that the shaft 23 is lengthened and the foil 8 is shortened, when seen along the axial length, in each case. The bedding in of the shaft in the pinch is then at least 6 mm. The coating 9 extends approximately from the pinch edge up to the end of the shaft on the foil. The ends of the coating are denoted by the reference numerals 30 and 29. Moreover, a frosting 12 is applied to both shafts 3*a* and 3*b*, and extends both in the case of the upper and of the lower pinch approximately from the outer end 20 of the pinch up to 60% of the length of the foil. The inner end of the frosting is denoted by 31.

Figure 3:
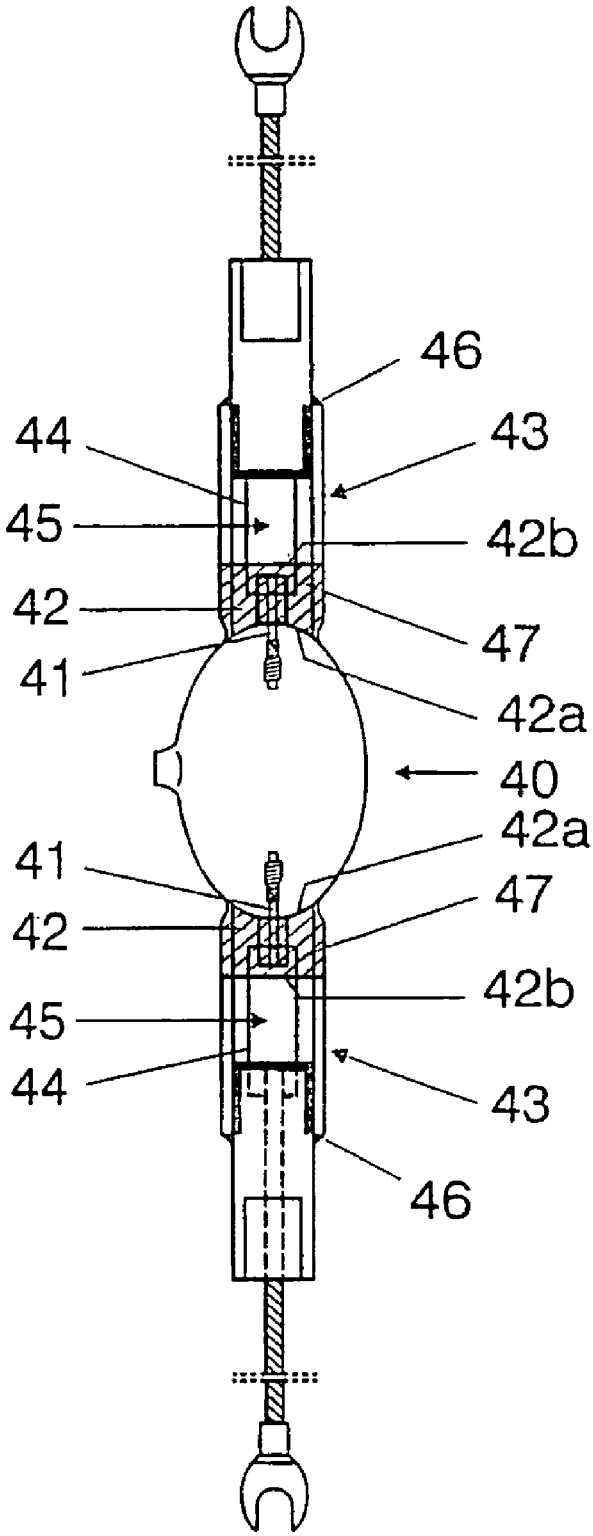

A further exemplary embodiment is shown in FIG. 3. This is a 2000 W metal halide lamp 40 for horizontal operating position that is otherwise similar to that described in FIG. 2. It is suitable for neutral white light colors from 3500 to 4800 K. The uniform temperature distribution permits the use of thin pins 41 as shaft (0.5 to 1.15 mm diameter) that can be embedded more tightly in the silica glass during pinching, and reduce the volume of the capillaries surrounding them as dead space. Such a thin shaft 41 must be compatible with the design of the halogen cyclic process, in particular through careful selection of the bromine/iodine ratio as set forth above. Such thin shafts additionally restrict the dissipation of heat such that additional accumulation of heat occurs at this point and prevents the production of a metal halide pool. This renders possible a symmetrical reflector coating 42 on the two pinches 43 of slight axial length, which avoids vignetting. A narrow coating 42 on the two pinches 43 lowers the wall loading caused thereby to approximately 60 W/cm$^2$. Moreover, the heat accumulation effect is further increased in that the shaft 41 is lengthened and the foil 44 shortened, seen along the axial length in each case. The bedding of the shaft in the pinch is approximately 12 mm. The coating 42 extends outward from the pinch edge 42*a* to 2 mm over the end of the shaft to the foil, the outer end being denoted by 42*b*. The ends of the coating are denoted by the reference numerals 30 and 29. A frosting 45 extends on both pinches approximately from the outer end 46 of the pinch up to 60% of the length of the foil. The inner end of the frosting is denoted by 47. It slightly overlaps with the outer end of the coating.

HgBr2 as well as the photoactive filling MnI2, CsI, TlI and DyI3 as well as TmI3 are used as metal halides. The ratio Br/I is approximately 1.1.

The invention claimed is:

1. A high-pressure discharge lamp comprising: an elongated discharge vessel, as sole bulb, that defines an axial axis of symmetry and that is closed at two ends by seals and encloses a discharge volume, two electrodes, whose shafts are connected to foils, being opposite one another on the axis, and that contains an ionizable filling made from mercury, inert gas and metal halides, and having supply leads that are connected to the electrodes via foils and that emerge at the ends of the discharge vessel, the lamp configured to be operated at a power of at least 1600 W, wherein the shafts are designed as pins with a diameter of 0.5 to 1.15 mm, and in which the halogen for the halides comprises the constituents iodine and bromine, use being made jointly of bromine and iodine, wherein the maximum bromine/iodine ratio is 1.45, wherein the filling comprises at least metal halides of mercury and from the group of the elements Cs and rare earth metals and additionally comprises metal halides of sodium and/or manganese, wherein the color rendition index of the lamp is at least 85, the light yield of the lamp is at least 90 lm/W, and the color temperature of the lamp lies between 3300K and 4800K.

2. The high-pressure discharge lamp as claimed in claim 1, wherein at least a portion of the seal that is adjacent to an electrode is provided with a reflecting coating.

3. The high-pressure discharge lamp as claimed in claim 2, wherein the coating comprises zirconium oxide.

4. The high-pressure discharge lamp as claimed in claim 1, wherein a portion of the two seals is frosted in each case.

5. The high-pressure discharge lamp as claimed in claim 1, wherein the rare earth metals selected are from the group Dy, Ho, Tm.

6. The high-pressure discharge lamp as claimed in claim 1, wherein the electrodes have shafts with a diameter of 0.9 to 1.1 mm.

7. The high-pressure discharge lamp as claimed in claim 1, wherein the color temperature of the lamp is at least 3300 K.

8. The high-pressure discharge lamp as claimed in claim 1, wherein the filling additionally contains a thallium metal halide.

* * * * *